US005464255A

United States Patent [19]

Schildmeyer

[11] Patent Number: 5,464,255

[45] Date of Patent: Nov. 7, 1995

[54] FOLDED BUSINESS FORM WITH RETURN ENVELOPE

[75] Inventor: John Schildmeyer, Claremont, Calif.

[73] Assignee: Uarco Incorporated, Barrington, Ill.

[21] Appl. No.: 150,213

[22] Filed: Nov. 10, 1993

[51] Int. Cl.[6] ..... B65D 27/10; B41L 1/20

[52] U.S. Cl. ..... 283/116; 283/62; 229/304; 229/305; 229/306; 462/65

[58] Field of Search ..... 283/116, 117, 283/62; 462/6, 64, 65, 27, 35, 45; 281/9; 229/301, 304, 305, 306, 92

[56] References Cited

U.S. PATENT DOCUMENTS

| | | | |
|---|---|---|---|
| 1,401,324 | 12/1921 | Dority et al. | 462/65 |
| 2,016,063 | 10/1935 | White | 283/116 X |
| 3,977,597 | 8/1976 | Wise et al. | 462/65 X |
| 4,632,427 | 12/1986 | Angus | 462/65 X |
| 5,294,041 | 3/1994 | Whiteside | 283/116 X |

FOREIGN PATENT DOCUMENTS

| | | | |
|---|---|---|---|
| 2337627 | 8/1977 | France | 283/116 |

*Primary Examiner*—Timothy V. Eley
*Assistant Examiner*—Khan V. Nguyen
*Attorney, Agent, or Firm*—Wood, Phillips, VanSanten, Clark & Mortimer

[57] ABSTRACT

A four panel mailer formed of a single sheet or ply of paper is including an elongated sheet (10) of material adapted to receive indicia and made up of four connected panels (18, 20, 22, 24) including two end panels (18, 24) at opposite ends of the sheet and two intermediate panels (20, 22) adjacent one another and located between and adjacent respective ones of the end panels (18, 24). One of the end panels (18) is somewhat longer in the direction of elongation of the sheet (10) than the other of the end panels (24) and has an address window (38). The other of the end panels (24) has two lines of apertures (66) extending in the direction of elongation of the sheet. As a consequence, the intermediate panels (20, 22) may be folded against and glued to each other to define a return envelope and the one end panel (18) may be folded over the other end panel (24) with glue (84) extending through the apertures (66) so that the end panels (18) and (24) are folded against one of the intermediate panels (22) to be glued thereto by glue (84) extending through the line of aperture (66).

11 Claims, 2 Drawing Sheets

FOLDED BUSINESS FORM WITH RETURN ENVELOPE

FIELD OF THE INVENTION

This invention relates to business forms, and more particularly, to mailers that are folded and which include a return envelope.

BACKGROUND OF THE INVENTION

The first practical mailers as a type of business form appeared in the 1960's with the advent of the type of form illustrated in U.S. Pat. No. 3,104,799, issued to D. J. Steidinger. That particular type of business form included a prestuffed, sealed envelope assembly wherein interior plies could be imaged with variable information through the use of interior image transfer systems such as interleaved carbon, hot spot carbon, mated front, coated back type systems, etc. The mailers were in continuous form and thus ideally suited to being imaged on computer operated printers. The mailers were utilized for a large variety of purposes. For example, they were commonly used by educational institutions to mail grade reports to students. In this type of usage, there was no need for a return envelope.

Conversely, many businesses employed this type of mailer to invoice customers. In this case, the customer was expected to return payment of the invoice and to facilitate that, the mailer included a return envelope.

As a result of the arrival of mailers of this sort on the scene, a whole new segment of the business forms industry developed. Specifically, the same developed to provide a large variety of different types of mailers as business forms that could be utilized to meet the needs of any of a variety of businesses. As part of this evolution, new business forms processing equipment for processing the mailers also were developed. Whereas the mailers of the type illustrated in the previously identified Steidinger patent were commonly manufactured in the manufacturing plants of the large business forms manufacturers, certain types of the newly developed equipment were intended for use by the user of the business form, which is to say that they were intended to be located at the place of business of the user of the business form and operated by the user's employees just as deleavers, bursters, trimmers and the like had been operated for many years.

This type of equipment has been referred to as glue folders. The equipment is particularly adapted to apply glue either to individual sheets of paper that are to be folded by the machine into an envelope or mailer or, in some cases, to individual form lengths of a continuous ply for the same purpose.

To facilitate handling of the sheets or ply, it is generally desirable that glue be placed by the machine on a single side of the sheet or ply of the paper. In this way, the opposite side remains free from glue and thus serves as a side by which the form may be supported during the processing thereof without concern for the form hanging up in the processing equipment as a result of contact between the glue and the processing equipment. This factor, in turn, has not made it particularly easy to provide a large variety of mailers that may be processed on such equipment and which meet the regulations of the United States Postal Service, requiring that such mailers be sealed on all sides. The difficulty of producing such a form becomes all the more acute when the mailer is intended to have a return envelope.

The present invention is directed to overcoming the above difficulty.

SUMMARY OF THE INVENTION

It is the principal object of the invention to provide a new and improved mailer. More particularly, it is an object of the invention to provide a new and improved mailer having a return envelope that may be assembled from a business form into the mailer on gluing and folding equipment at the location of the user of the mailer.

An exemplary embodiment of the invention contemplates a business form that includes an elongated sheet of material adapted to receive indicia. The sheet is made up of four connected panels including two end panels at opposite ends of the sheet and two intermediate panels adjacent one another and located between and adjacent respective ones of the end panels. One of the end panels is somewhat longer in the direction of elongation of the sheet than the other of the end panels. The other of the end panels has two lines of apertures, one adjacent each marginal edge and extending in the direction of elongation of the sheet.

As a consequence of this construction, the intermediate panels may be folded against and glued to each other to define a return envelope and the one end panel may be folded over the other end panel with glue on the marginal edges of the one end panel extending through the apertures and the lines of apertures so that both of the end panels may be folded against one of the intermediate panels to be glued thereto by glue extending through the lines of apertures.

In a highly preferred embodiment, the one end panel is provided with an address window.

The invention contemplates that one of the end panels include a transverse line of weakening adjacent to but spaced from its interface with the adjacent intermediate panel to thereby define the flap of a return envelope.

In a highly preferred embodiment, a line of remoistenable glue is located between the line of weakening and the interface.

A highly preferred embodiment of the invention contemplates a business form that includes an elongated sheet adapted to be folded upon itself to define a mailer with a self-contained return envelope. The sheet has a first, relatively long end panel with one side provided with first glue receiving regions along two opposed marginal edges. The sheet has connected first and second intermediate panels of substantially equal length and whose length is less than the length of the first end panel. The first intermediate panel adjoins the first end panel.

At least one of the first and second intermediate panels has second glue receiving regions along two opposed marginal edges and aligned with the first glue receiving regions on the first end panel. One of the first and second intermediate panels further includes third glue receiving regions along two opposed marginal edges and inwardly of the second glue receiving regions.

The sheet has a second end panel of a length less than that of the intermediate panels and adjoining the second intermediate panel. Two lines of glue bleed through means are disposed on the second end panel, one along each of two opposed marginal edges and aligned with a first glue receiving region on the first end panel. The glue bleed through means are for the purpose of allowing glue received in the first glue receiving regions to bleed through the second end panels so that the first end panel may be adhered to the second intermediate panel via the second end panel and the glue bleed through means.

In a highly preferred embodiment of the invention, all of the glue receiving regions are on the same side of the sheet.

Preferably, an address window is located in the first end panel.

Typically, one of the intermediate panels has a return address preprinted thereon on the side of the sheet opposite the glue receiving regions.

The invention contemplates that the glue bleed through means comprise holes in the second end panel and in a highly preferred embodiment, the holes are provided by punches.

The fact that the first end panel is longer than the second end panel and the intermediate panels provides a flap for the original mailer, allowing the same to be sealed on all four sides.

Other object and advantages will become apparent from the following specification taken in connection with the accompanying drawings.

DESCRIPTION OF THE PREFERRED EMBODIMENT

Figure 1:
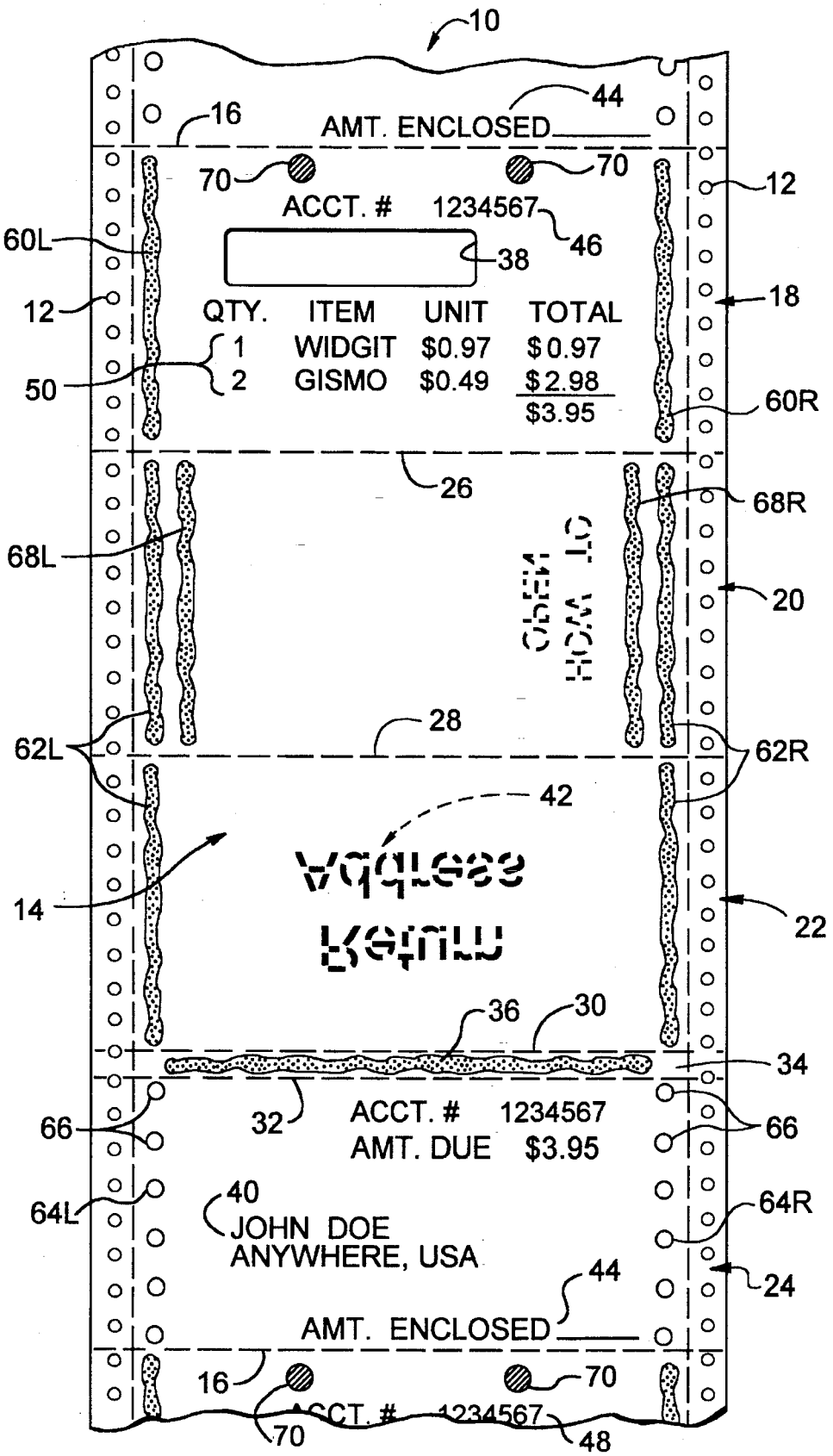
FIG. 1 is a plan view of a continuous business forms assembly embodying one form length of a business form made according to the invention.

An exemplary embodiment of a business form made according to the invention may be made either of individual sheets or in continuous form. As illustrated in FIG. 1, the same is seen to be in continuous form but it is to be expressly understood that unless so limited by the appended claims, the invention can be made out of individual sheets as well.

A single continuous, elongated ply of paper, generally designated 10, is provided. The same has removable control punch margins 12 on both sides thereof to facilitate processing of the form during its manufacture, usually, to facilitate the printing of so-called fixed information at the proper location on the form and to provide registration when lines of weakening, such as lines of perforation are applied.

In some cases, the control punch margins 12 may be utilized in subsequent processing but generally, they will be removed from the business form prior to the same being deposited in the mail as is well known.

The top and bottom of one form length, generally designated 14, the business form is defined by adjacent transverse lines of weakening 16 which typically will be lines of perforation as is well known. The business form 14 lying between adjacent lines of weakening 16 is divided into four panels, a first of which is generally designated 18, a second of which is generally designated 20, a third of which is generally designated 22, and the fourth of which is generally designated 24. In relation to the individual form length, it will be seen that the panel 18 is an end panel as is the panel 24 whereas the panels 20 and 22 are intermediate panels which are respectively adjacent and adjoined the end panel 18 and the end panel 24. Typically, in the direction of elongation of the ply 10, the second and third panels 20 and 22 will have equal lengths while the first panel 18 will be somewhat longer than the length of the panels 20 or 22 while the panel 24 will be somewhat shorter in length than the panels 20 and 22.

In one embodiment of the invention, it is contemplated that the length of the first end panel 18 will be 3¾ inches while the length of both the intermediate panels 20 and 22 will be 3½ inches. The length of the second end panel 24 will be 3¼ inches. However, those skilled in the art will readily appreciate that these dimensions can vary substantially, depending upon the use to which the form is put and the amount of information to be conveyed with each mailer.

Figure 2:
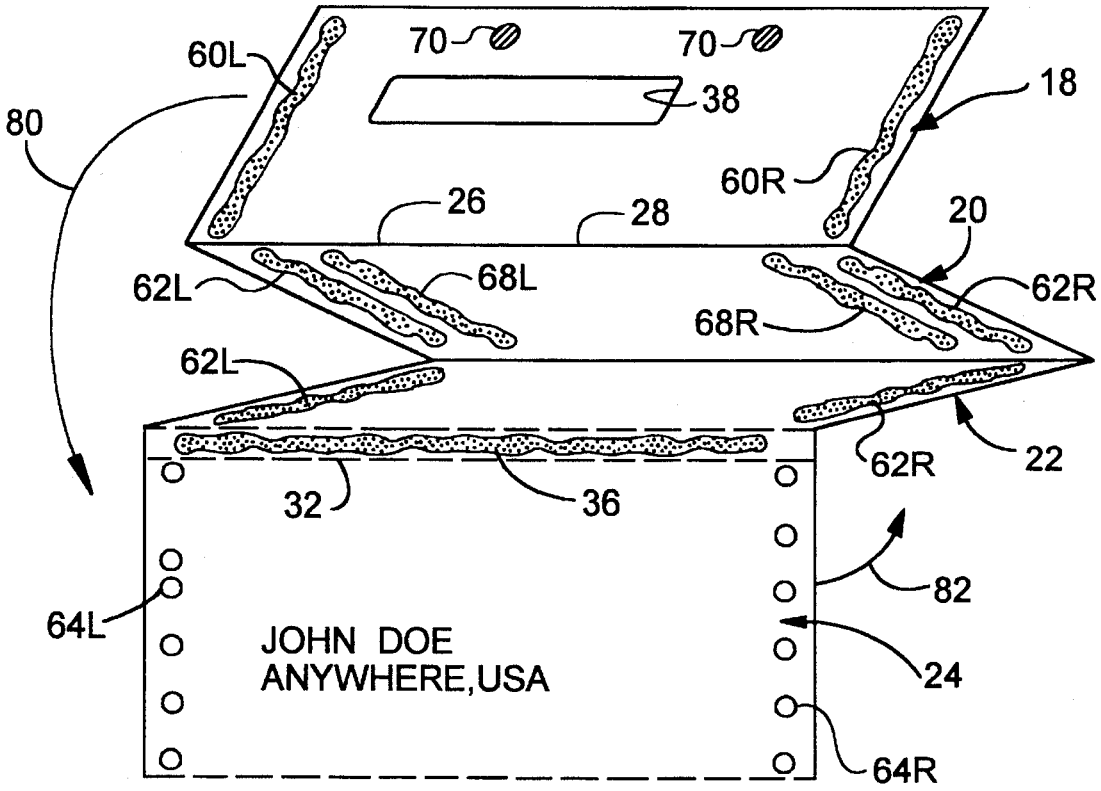
FIG. 2 is a perspective view illustrating one form length of the business form in the process of being folded to provide an assembled business form.

The end panel 18 and the intermediate panel 20 are separated by a line of perforation 26 which allows separation of the panel 18 from the remainder of the business form. The intermediate panels 20 and 22 are separated by a line 28 which may not even appear on the business form but is a line upon which the form will be folded to bring the panels 20 and 22 into adjacency with each other as seen in FIG. 2.

A similar actual or mythical line 30 which serves as a fold line defines the interface of the second intermediate panel 22 and the second end panel 24. In addition, closely adjacent the line 30 is a line of perforation 32 which extends transversely across the form. The line 32 is in the second end panel 24 and serves to define a flap 34 for a return envelope as will be seen. According to the invention, a strip of remoistenable glue 36 may be located between the line of perforation 32 and the fold line 30.

Returning to the first end panel 18, the same includes an address window 38 of conventional construction. When the form is folded as illustrated in FIG. 2, the window 38 overlies a recipient address area 40 on the second end panel 24. That is to say, the area 40 receives variable information identifying the intended recipient of the mailer.

In this regard, it should be noted that the terms "variable information" and "fixed information" have their standard meetings in the art. That is to say, "variable information" is information that is unique to each individual form. It may include, for example, addressee information, account number information, goods and quantity identification, etc. On the other hand, fixed information will be information that is the same from one form length to the next. Typically, fixed information might include the designation "ACCT #" or the words quantity, item, unit, total, amount enclosed etc.

One important bit of fixed information will typically be a return address. In a preferred embodiment of the invention, the return address is printed on the second intermediate panel 22 on the side thereof opposite that illustrated in FIG. 1. The legend "return address" is seen in dotted lines in FIG. 1 in the area generally designated 42. Another example of fixed information is the designation "AMT enclosed", designated 44 while account numbers "1234567" and "1234568" are variable information given the designations 46 and 48 respectively. Other variable information is shown by the bracket 50 on the first end panel 18 in FIG. 1.

Located on the first end panel 18, adjacent opposite marginal edges thereof, are first glue receiving areas 60R and 60L. These areas extend longitudinally of the business form and, as mentioned previously, are closely adjacent the fight and left hand marginal edges of the form.

Second glue receiving areas 62R and 62L may be located on the marginal edges of one or the other or both of the intermediate panels 20 and 22. The second glue receiving regions 62R and 62L are respectively aligned with the first glue receiving regions 60R and 60L.

The second end ply 24 does not have glue receiving region. Rather, the same includes, at opposite marginal edges, glue bleed through means 64R and 64L in the form of a line of apertures 66. The apertures 66 are in alignment with the glue receiving regions on the associated side of the form.

Finally, one or the other of the intermediate panels 20 and 22 is provided with third glue receiving regions 68R and 68L which are adjacent opposite marginal edges of the panel and located just inwardly of the second glue receiving regions 62R and 62L.

A somewhat frangible glue is located in the first and second glue receiving regions 60R, 60L, 62R, 62L as these glue lines are intended to be broken by the recipient in the course of opening the mailer. However, as the glue received in the third glue receiving region 68R and 68L is expected to, together with the fold at the line 28, define a pocket for the return envelope, a relatively strong glue will be used at this location.

The form is completed by a couple of frangible glue spots on the panel 18. The glue spots are shown at 70 and are closely adjacent the transverse line of weakening 16.

In using the form, the form is preprinted at the factory to provide the desired fixed information thereon. Thereafter, the forms are shipped to the customer. As the customer requires the forms for a mailing, they are fed through a computer printer and the variable information imaged thereon. Following imaging, the forms are then passed to a glue folding machine which applies glue at all of the previously mentioned areas except the glue line 36 which typically will be placed on the form at the place of manufacture. The glue folding machine, after placing the glue on the form, will fold the form so that the intermediate panels 20 and 22 come together in the form of a "V" as illustrated in FIG. 2. This will define the pocket for the return envelope when the glue in the second and third glue receiving areas 62R, 62L, 68R and 68L cures. After the pocket is formed, then the panel 18 may be folded in the direction of an arrow 80 and the second end panel is folded in the direction of an arrow 82 into abutment with the second intermediate panel 22. Because glue bleed through means in the form of the apertures 66 are aligned with the glue in the glue receiving area 60R and 60L on the first end panel 18, such glue will pass through the apertures 66 as indicated by "X's" 84 in FIGS. 3 and 4 to thereby glue the first end panel 18 to the second intermediate panel 22 via the second end panel 24. At the same time, certain of the glue in the glue receiving areas 60R and 60L will be located between the apertures 66 and will form bonds indicated by "X's" 86 in FIG. 3 with the second end panel 24.

Figure 3:
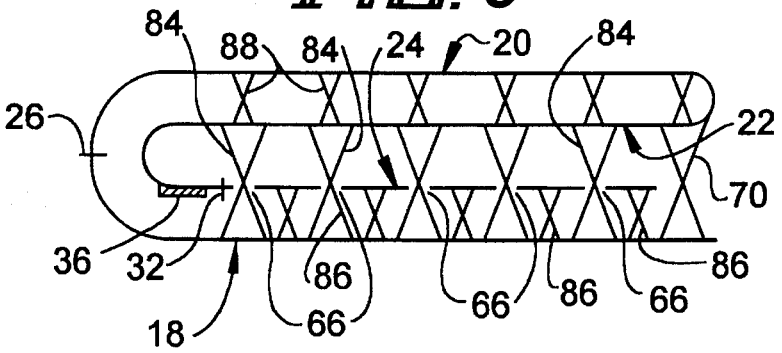
FIG. 3 is a somewhat schematic, sectional view of the business form taken across its length after the same has been assembled.
Figure 4:
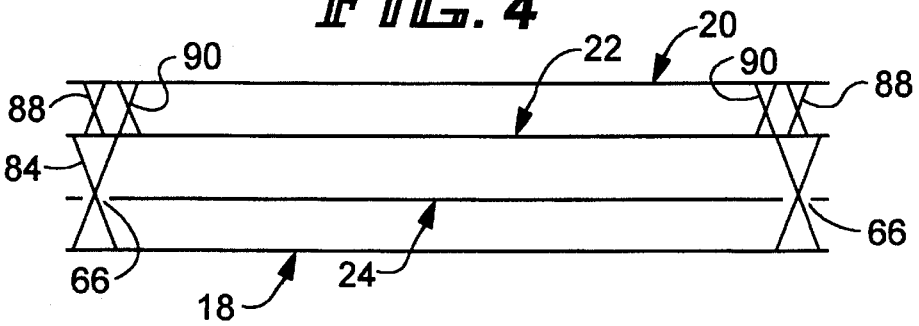
FIG. 4 is a sectional view of the business form taken at 90° to the section of FIG. 3.

"X's" 88 in FIGS. 3 and 4 indicate the second glue receiving regions 62R, 62L bonding the intermediate panels 20 and 22 together. "X's" 90 in FIG. 4 indicate the action of the glue in the third glue receiving region 68R and 68L in forming the pocket of the return mailer. The remoistenable adhesive on the return envelope flap is shown at 36 in FIG. 3 as well while the perforation lines 26 and 32 are designated by slashes in FIG. 3.

It will also be appreciated that because the first panel 18 is longer than the second end panel 24, it extends past the end thereof so that the glue spot 70 may bond to the second intermediate panel 22, or folded around, to the first intermediate panel 20 as desired.

Thus, it will be appreciated that the resulting mailer is sealed on four sides. When it is received by the recipient, the recipient need only insert his fingers between the glue spots 70 to break the adherence provided by such glue spots. The relative weakness of the glue utilized in the first and second glue receiving regions 60R, 60L, 62R, 62L allows the form to be opened generally to the configuration illustrated in FIG. 2 except that the intermediate panels 20 and 22 will remain in abutment to maintain the return envelope pocket by reason of the strong glue applied at the third receiving region 68R and 68L.

The first panel 18 may be removed from the assemblage by separation along the line of perforation 28 and may be retained by the recipient as a record of the transaction. At the same time, the majority of the second end panel 24 may be removed by tearing along the line of perforation 32. The second panel 24 may then be stuffed into the return envelope pocket to identify the account returning payment and any other pertinent information that might be appropriately placed on the panel 24. The flap 34 of the return envelope may then be folded on the line 30 to close the pocket and the remoistenable adhesive 36 moistened so that the flap 34 may be sealed to the return envelope.

The return envelope may then be deposited in the mail for delivery to the entity whose return address appears in the area 42 (FIG. 1). From the foregoing, it will be appreciated that the invention provides a business form that is ideally suited for use with modern glue folding machines. All of the glue is kept on one side of the form for ease of handling. The form provides a secure form in that all four sides of the outgoing mailer are sealed and yet a simple return mailer is included with the original mailer.

The unique use of the bleed through means 64R, 64L makes it possible to achieve appropriate folding of a four panel form without the need for placing glue on both sides of the form.

I claim:

1. A business form comprising:

an elongated sheet of material for receiving indicia, said sheet comprising four connected panels including two end panels at opposite ends of said sheet and two intermediate panels adjacent one another and located between and adjacent respective ones of said end panels;

one of said end panels being somewhat longer in the direction of elongation of said sheet than the other of said end panels and having an address window;

the other of said end panels having two lines of apertures, one adjacent each marginal edge and extending in the direction of elongation of said sheet;

said intermediate panels foldable against and glueable to each other to define a return envelope and said one end panel being foldable over said other end panel with glue on the marginal edges of said one end panel extending through the apertures in said lines whereby both said end panels being foldable against one of said intermediate panels to be glued thereto by glue extending through said lines of apertures.

2. The business form of claim 1 wherein one of said end panels includes a transverse line of weakening adjacent to but spaced from its interface with the adjacent intermediate panel to define the flap of a return envelope.

3. The business form of claim 2 including a remoistenable glue line between said line of weakening and said interface.

4. A business form comprising:

an elongated sheet foldable upon itself to define a mailer with a self-contained return envelope;

said sheet having a first, relatively long, end panel with one side provided with first glue receiving regions along two opposed marginal edges;

said sheet having connected first and second intermediate panels of substantially equal length less than the length of said first end panel;

said first intermediate panel adjoining said first end panel;

at least one of said first and second intermediate panels having second glue receiving regions along two opposed marginal edges and aligned with said first glue receiving regions on said first end panel;

one of said first and second intermediate panels further having third glue receiving regions along two opposed marginal edges and inwardly of said second glue receiving regions;

said sheet having a second end panel of a length less than that of said intermediate panels and adjoining said second intermediate panel; and two lines of glue bleed through means in said second end panel, one along each of two opposed marginal edges and aligned with said first glue receiving regions;

said glue bleed through means being for allowing glue received in said first glue receiving regions to bleed through said second end panel so that said first end panel may be adhered to said second intermediate panel via said second end panel and said glue end panel and said glue bleed through means.

5. The business form of claim 4 wherein all of said glue receiving regions are on the same side of said sheet.

6. The business form of claim 4 wherein said first end panel includes an address window.

7. The business form of claim 5 wherein one of said intermediate panels has a return address preprinted thereon, on the side of said sheet opposite said glue receiving regions.

8. The business form of claim 4 wherein said glue bleed through means comprise holes in said second end panel.

9. The business form of claim 8 wherein said holes are defined by punches.

10. A business form comprising:

an elongated sheet foldable upon itself to define a mailer with a self-contained return envelope;

said sheet having a first end panel with one side provided with first glue receiving regions along two opposed marginal edges;

said sheet having connected first and second intermediate panels;

said first intermediate panel adjoining said first end panel;

at least one of said first and second intermediate panels having second glue receiving regions along two opposed marginal edges and aligned with said first glue receiving regions on said first end panel;

one of said first and second intermediate panels further having third glue receiving regions along two opposed marginal edges and inwardly of said second glue receiving regions;

said sheet having a second end panel adjoining said second intermediate panel; and two lines of glue bleed through means in said second end panel, one along each of two opposed marginal edges and aligned with said first glue receiving regions;

said glue bleed through means being for allowing glue received in said first glue receiving regions to bleed through said second end panel so that said first end panel may be will adhere to said second intermediate panel via said second end panel and said glue end panel and said glue bleed through means.

11. A business form comprising an elongated sheet of material for receiving indicia, said sheet comprising four connected panels including two end panels at opposite ends of said sheet and two intermediate panels adjacent one another and located between and adjacent respective ones of said end panels;

one of said end panels having an address area;

the other of said end panels having two lines of apertures, one adjacent each marginal edge and extending in the direction of elongation of said sheet;

said intermediate panels being foldable against and glued to each other to define a return envelope and said one end panel being foldable over said other end panel with glue on the marginal edges of said one end panel extending through the apertures in said lines whereby both said end panels are foldable against one of said intermediate panels to be glued thereto by glue extending through said lines of apertures.

* * * * *